US005290500A

United States Patent [19]

Ryan

[11] Patent Number: 5,290,500

[45] Date of Patent: Mar. 1, 1994

[54] METHOD FOR HEAT STRETCHING SYNTHETIC FIBER ROPE

[75] Inventor: Richard J. Ryan, Anacortes, Wash.

[73] Assignee: Puget Sound Rope Corporation, Anacortes, Wash.

[21] Appl. No.: 922,552

[22] Filed: Jul. 29, 1992

[51] Int. Cl.[5] ..... D02J 1/22

[52] U.S. Cl. ..... 264/291; 264/289.6; 264/DIG. 73; 425/392

[58] Field of Search ..... 264/291, 289.6, DIG. 73; 425/392

[56] References Cited

U.S. PATENT DOCUMENTS

| | | | |
|---|---|---|---|
| 2,371,579 | 3/1945 | Cole et al. | 264/289.6 |
| 3,086,275 | 4/1963 | Pritchard | 264/289.6 |
| 3,364,289 | 1/1968 | Campbell | 264/289.6 |
| 4,141,679 | 2/1979 | Asano et al. | 264/DIG. 73 |
| 4,348,350 | 9/1982 | Meier et al. | 264/291 |
| 4,612,148 | 9/1986 | Motooka et al. | 264/289.6 |

*Primary Examiner*—James Lowe

*Attorney, Agent, or Firm*—Hughes & Multer

[57] ABSTRACT

A method and apparatus for heat stretching a synthetic fiber rope. The rope is attached to tensioning members and suspended in a liquid medium so that this extends in a generally horizontal direction. The liquid medium has a specific gravity which is approximately equal to that of the rope at the desired stretching temperature, so that the rope is buoyed by this in order to relieve the weight of the segment from the tensioning members. The liquid medium is then heated so that the rope is uniformly heated to the stretching temperature, and tension is applied between the tensioning members so as to stretch the segment of rope to a predetermined increase in length.

14 Claims, 5 Drawing Sheets

42
44
46
48
70
24
28
62
56
66
60
20
36
64
22
52
38
34
54

METHOD FOR HEAT STRETCHING SYNTHETIC FIBER ROPE

FIELD OF THE INVENTION

The present invention relates generally to ropes and cordage, and more particularly, to a method and apparatus for heat stretching synthetic rope so as to enhance its load-bearing capabilities and other characteristics.

BACKGROUND

Typically, synthetic rope or cordage is made up of many thousands of individual strands of synthetic fiber. Each of these fibers has a certain load-bearing capacity (e.g., breaking strength), and theoretically, the total load-bearing capacity of the rope should be equal to the sum of these. However, in practice, this is not so: during the normal fabrication of the rope, the individual fibers do not all end up being of equal length, and so some of these take up the load while others may not do so until the shorter strands break. This problem has become more severe with the advent of ultrahigh strength fibers which stretch very little (e.g., 2%) before parting, as opposed to the 40% stretch or so which was exhibited by earlier nylon fibers and the like.

As a result, the actual load-bearing capacity of a rope is normally some relatively small fraction of the combined capacity of its fibers. In the art, this is expressed as "translational efficiency". For example, relatively large diameter synthetic lines (e.g., ⅜"–4") may typically have a translational efficiency as low as 30–40%. As a result, for a given application, these ropes must be much larger, heavier, and more difficult to handle than would be the case if their translational efficiencies were nearer their theoretical maximums.

Heat stretching of synthetic lines can dramatically increase translational efficiency. When the line is heated, the modulus of elasticity of the fibers is reduced, and then when tension is applied, the shorter fibers are stretched out until the longer ones begin to take a load, and are also stretched out; finally the great majority of the fibers will have the same length and so will be able to bear loads equally.

Heat stretching also tends to improve the structure of synthetic lines on a molecular level. As is known, the molecules of the initial fiber material are often poorly aligned in a somewhat isotropic state; heat stretching essentially "pulls" the polymer material out so as to cause alignment of a greater proportion of the chains of macro molecules along the fiber axis, so that these can bear tensile loading in a more efficient manner.

Heat stretching has been employed previously to achieve these goals, but only with individual yarns or very small diameter synthetic line. For example, both fishing line and bow strings have been successfully stretched by means of a hot gas process. This involves running the line between unequal diameter (or unequal speed) payout and takeup reels, and through a stream of heated air or other gas. The temperature of the gas is typically such that the line would be destroyed if it were to pause in the stream, but the reels are operated at a high rate of speed so that the line is only momentarily softened and stretched in the heated zone before cooling again.

The heat stretch process described in the preceding paragraph works well with very small diameter (e.g., 1/32") synthetic line, but it is inherently unsuitable for use with much larger lines such as braided or twisted rope, which may range upwardly of 4" in diameter. Firstly, the arrangement of high speed payout and takeup reels is simply impractical for handling of rope of this size, at least on an economical basis. Also, the insulating qualities of the rope material would tend to prevent the core of the rope from becoming sufficiently heated to permit stretching before the exterior of the rope degraded in the hot gas stream; the heated gas provides a poor medium for uniformly heating the rope material, and it is also very difficult to control this so as to maintain an accurate temperature very close to the melting point of the rope fibers.

Yet another serious problem stems from the weight of the rope itself (e.g., up to 5 lbs./ft. or more). If a segment of the rope is suspended between a pair of support points (for example, between a pair of eyes, or between a payout and takeup reel), this weight will tend to make the segment droop downwardly towards its center and place a heavy strain on the rope near the support points; if the rope has been heated for stretching, this will tend to cause the material to over-stretch and "neck down" near the support points, with a result that the utility of the rope is destroyed.

While these problems have previously presented themselves with respect to heat stretching synthetic ropes, certain newly developed fiber materials exhibit characteristics which intensify these difficulties. One such a material is an ultrahigh molecular weight polyethylene (UHMWPE) fiber marketed by Allied Signal Corporation under the trademark "SPECTRA". This is a high specific strength material which is very abrasion and UV resistant, and which possesses a high specific modulus of elasticity and a low specific gravity. These qualities render it highly desirable for use in rope. However, the material also presents severe difficulties from the standpoint of previously-known heat stretching techniques: it possesses a low melting point (147° C.) and its tensile properties drop off rapidly near this temperature, and it also acts as an excellent thermal insulator. Accordingly, these characteristics make it very difficult to stretch a rope made of the SPECTRA TM fibers using conventional heat stretch processes.

SUMMARY OF THE INVENTION

The present invention has solved the problems cited above, and is a method for heat stretching synthetic fiber rope. This comprises attaching tensioning members to first and second ends of a segment of the rope, and suspending the segment in a liquid medium so that the segment extends in a generally horizontal direction. The liquid medium has a specific gravity approximately equal to that of the rope at a predetermined stretching temperature so that the segment is buoyed by the medium to relieve the weight of the segment from the tensioning members. The liquid medium is heated so that the segment of rope which is buoyed therein is uniformly heated to the stretching temperature, and then tension is applied between the tensioning members so as to stretch the heated segment of rope to a predetermined increase in length.

The step of suspending the segment in the liquid medium may comprise positioning the segment in a vessel so that the segment extends generally horizontally therein, and at least partially filling this vessel with the liquid medium. The heating of the liquid medium may comprise the sequential steps of heating the liquid medium while maintaining a pressure in the vessel so as to prevent boiling of the medium, until this is heated to a temperature at least equal to the stretching temperature. The pressure in the vessel is then reduced to a level at which the liquid medium will boil at the stretching temperature, so that the liquid medium is stabilized at this temperature uniformly throughout the vessel. The liquid medium may be kept boiling at the stretching temperature for predetermined period of time which is sufficient to overcome the thermal insulating qualities of the rope, so that the rope is uniformly heated to the stretching temperature to its core.

Once the rope has been elongated, the pressure and temperature in the vessel may be reduced so as to cool the segment of rope below the stretching temperature. To do this, the pressure in the vessel may be rapidly reduced to atmospheric so that the temperature of the liquid medium falls rapidly below the stretching temperature. As the segment of rope cools, a predetermined amount of tension may be maintained on this so as to prevent shrinkage.

The stretching temperature may be selected such that the tensile resistance of the synthetic fiber of the rope is reduced to a level at which the segment may be stretched at a predetermined rate of elongation without breakage of the fibers of the rope. This stretching temperature may be selected to be approximately equal to or somewhat below the melting temperature of the fibers.

An apparatus for heat stretching a synthetic fiber rope is also provided, and this comprises tensioning members for attachment to first and second ends of a segment of the rope, and means for suspending the segment in a liquid medium so that the segment extends in a generally horizontal direction. The liquid medium has a specific gravity approximately equal to that of the rope at a predetermined stretching temperature so that the segment is buoyed by this to relieve the weight from the tensioning members. Means are provided for heating the liquid medium so that the segment of rope which is buoyed therein is uniformly heated to the stretching temperature, and means are provided for applying tension between the tension members so as to stretch the heated segment of rope to a predetermined increase in length.

The means for suspending the segment of rope in the liquid medium may comprise a vessel which is configured to receive the segment of rope so that this extends generally horizontally therein, and means for at least partially filling this vessel with the liquid medium. This vessel may be an elongate, horizontally extending tube member having a bore for receiving the segment of rope, and end cap members which are sealingly mountable to first and second ends of this so as to prevent the escape of pressure from the tube member.

The tensioning members may comprise at least one draw rod which extends longitudinally into the bore and has an inner end which is configured for attachment to a first end of the segment of rope. Means are provided for withdrawing the draw rod longitudinally through the bore so as to apply a predetermined amount of tension to the rope. At the other end of the segment, there is a stationary link having an inner end which is configured for attachment to the rope, so as to hold the second end of the rope segment stationary as the other end is pulled by the draw rod.

The draw rod may extend outwardly from the first end of the tube member through an end cap member, this end cap member having a bore which is configured to permit the draw rod to slide therethrough, but to form a fluid-tight seal therewith. The means for withdrawing the draw rod longitudinally through the bore may be winch means attached to the outwardly extending end of the draw rod.

DETAILED DESCRIPTION

I. Apparatus

Figure 1:
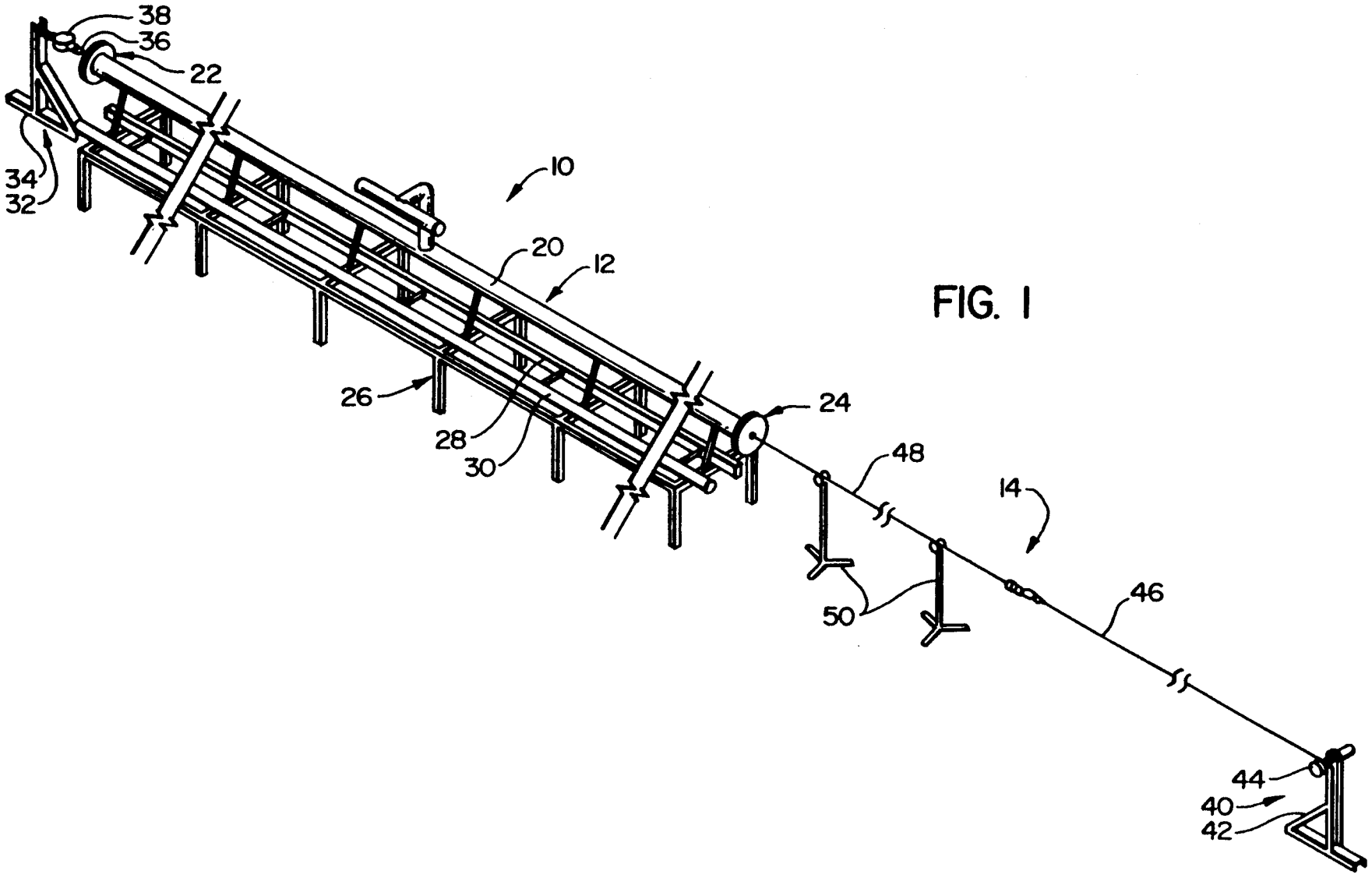
FIG. 1 is a perspective view of a rope stretching apparatus in accordance with the present invention, this comprising generally a tube assembly for suspending and heating the rope, and a tensioning assembly for stretching the rope.

According to one embodiment of the invention, FIG. 1 shows a rope stretching apparatus 10, this comprising generally a tube assembly 12 and tensioning assembly 14.

The principal functions of the tube assembly are to suspend the rope in a liquid medium so as to avoid placing weight on its attachment points, and to also ensure even heating of the rope to the desired stretching temperature. Accordingly, tube assembly 12 comprises an elongate tube member 20 closed off by end cap members 22, 24, so that this defines a cylindrical chamber for holding the rope and the liquid heating medium. Being that 800' is the maximum length in which relatively large diameter ropes are normally supplied in the industry, tube member 20 is preferably approximately this long, so that the treated ropes can have this length upon completion of stretching.

Tube member 20 is supported by a framework 26, preferably so that the tube member is free-floating on the framework in order to accommodate expansion. A burner rail 28 is mounted to the framework directly below tube member 20, and a gas/air mixture is provided to this by a manifold 30 which extends parallel to the burner rail. Thus, when the gas/air mixture is supplied to the burner rail and ignited, this provides a source of heat for the tube member. Of course, if desired, other sources of heat may be employed in place of the burner rail, including a steam jacket or electric band heater, for example.

As will be described in greater detail below, the segment of rope to be stretched is positioned so that this extends horizontally through tube member 20, and its ends are attached to the tensioning assembly 14. The tensioning assembly is made up generally of a stationary portion which is attached to one end of the rope, and a drawing portion which is attached to the other end of the rope. The stationary portion 32 is provided by a stanchion 34 which is anchored to the plant floor or other support surface, and a fixed-length link 36 which attaches to the first end of the rope. A tensiometer 38 is mounted between the link and the stanchion so as to provide a visual indication of the tension loading to which the rope is subjected.

The drawing portion 40, in turn, is made up of a second support stanchion 42, and in the illustrated embodiment this provides an anchor for a winch 44, which may be either electrically or hydraulically operated. The winch selectively applies tension to a cable 46, and the end of this is mounted to a draw rod 48. The rod extends through an opening in end cap member 24 and into the interior of tube member 20. The inner end of the draw rod 20 is attached to the second end of the rope inside of tube member 20, so that tension may be applied by activating winch 44 and drawing rod 48 outwardly through end cap 24. As the draw rod is pulled out of the tube, it is supported on spaced-apart roller stands 50. Of course, other means for applying tension to the draw rod may be substituted for the winch 44, including air or pneumatic cylinders, for example.

Figures 2, 3, 4:
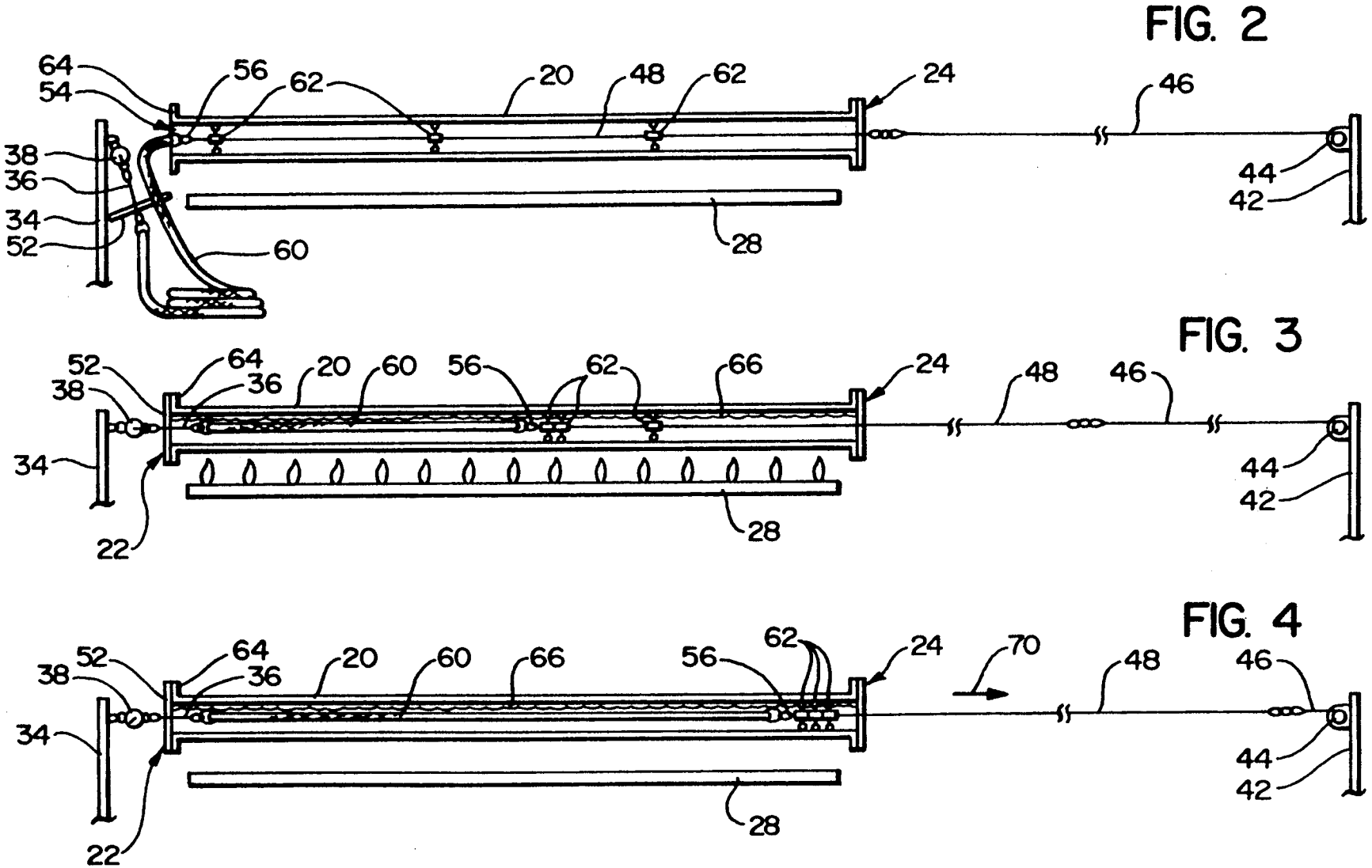
FIG. 2 is a longitudinal cross section through the apparatus of FIG. 1, showing a segment of rope being fed into the tube assembly in preparation for stretching.
FIG. 3 is a view similar to that of FIG. 2, showing the rope suspended in the tube assembly and being heated in preparation for stretching.
FIG. 4 is a view similar to those of FIGS. 2–3, this showing the rope having been stretched to an extended length by the tensioning assembly.

FIGS. 2-3 illustrate the basic sequence of operations by which this apparatus is used to heat stretch a segment of rope. FIG. 2 shows the initial loading of the tube assembly. To do this an end plate 52 is removed from end cap member 22 so as to open the bore 54 of the tube member, and draw rod 48 is run fully into tube member 20 so that its inner end 56 is positioned near the opening so that personnel can reach this. The first end of the rope 60 is then shackled or otherwise attached to the end of the draw rod, and then winch 44 is operated to pull rod 48 back into tube member 20 as personnel feed the rope into the bore; as will be described in greater detail below, rod 48 is supported for this movement by a series of trolley units 62. Then when the second end of the rope reaches the opening into bore 54, the take-up on winch 44 is halted, and end plate 52 is mounted back on flange 64 so as to seal the bore. As was noted above, this end of the rope is shackled to one end of link 36, which extends through an orifice in the end plate 52.

After sealing, the tube is at least partially filled with a liquid medium 66. This medium serves several purposes. Firstly, it buoys the rope so as to give it essentially neutral buoyancy, thus eliminating the tendency of the weight of the rope to cause uneven stretching and "necking down" at the attachment points. For this reason, the specific gravity of the fluid (at the intended stretching temperature) is preferably approximately equal to that of the rope material; consequently, it has been determined that water is a suitable liquid medium for use with ropes made of the Spectra TM material discussed above, being that both of these have a specific gravity of approximately 0.97 at 140° C.

Figure 6:
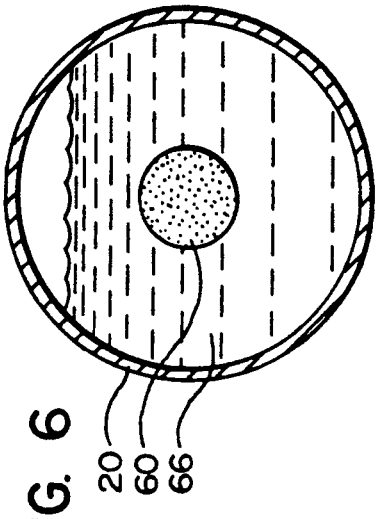
FIG. 6 is an isometric view similar to FIG. 5, showing the tension rod having been withdrawn so as to stretch the rope, and the manner in which the trolley units move together as this is done.

Furthermore the liquid medium serves as a conductive medium for transferring heat to the rope, and it also serves to establish uniformity of heating throughout the length of the tube, by taking advantage of the boiling point phenomenon which is exhibited by the liquid. This is done by filling most of the tube with the liquid, but leaving a small air gap (about 1" in an 8" diameter tube), as can be seen in FIG. 3, and also FIG. 6. The supply of gas/air mixture to burner rail 28 is then turned on and ignited (see FIG. 3), and as the water begins to heat, the tube member is maintained in a sealed condition so as to prevent the escape of pressure; this causes the pressure in the tube to increase so as to prevent the liquid from boiling as it is being heated. The pressure in the tube is monitored, and heating continues until the pressure reaches the point where this corresponds to the boiling point for the liquid at the desired temperature for stretching the rope. For example, if it is desired to stretch a rope made of the Spectra TM material described above at 140° C., and water is employed as the liquid medium, the heating continues until the pressure reaches 37.3 psi; similarly, if stretching at 135° C. is desired, the water is heated until the pressure reaches 30.3 psi, and so on. At this point, the pressure in the tube member is relieved in a controlled manner, so that the liquid begins to boil along the entire length of the tube. In this manner, temperature differentials (i.e., "hot" and "cold" spots) are eliminated: the hot spots boil more rapidly and the cold spots boil more slowly until an equal temperature is achieved throughout the tube member. This also ensures that there is thorough heating of the fibers of the rope, and in those cases where the insulating qualities of the fibers are expected to be a significant factor, the known thermal conductivity of the fiber material may be used to calculate how long it will take to overcome this so as to heat the rope to its core, and the elevated temperature can be maintained for this period of time.

Once the rope has been heated to the desired temperature, stretching commences by applying tension with winch 44 so that draw bar 48 is withdrawn from the end of tube member 20 in the direction indicated by arrow 70 in FIG. 4. As this is done, the rope is elongated, with a 33-67% increase in length being typical, and there is a corresponding decrease in the diameter to the rope. The tension is monitored during this step by viewing tensiometer 38, so as to avoid excessive loading and possible damage of the rope.

Once the rope has been stretched to the desired length, the retraction of draw rod 48 is halted, and then the remaining pressure in the tube assembly is bled off to begin cooling; as this is done, the material of the rope regains its tensile strength. If desired, a residual tension may be maintained on the rope during cooling, so as to prevent shrinkage. Also, it should be noted here that, if desired, the increase in tensile strength which occurs upon cooling may be employed to terminate stretching of the rope at the desired length, rather than controlling this by shutting down the winch; in other words, when the rope has reached the desired length, the pressure may be dumped from the tube member (either manually or automatically), and the resulting rapid decrease in temperature will be accompanied by a corresponding rapid increase in the tensile resistance of the rope such that this will exceed the tension which is applied by the winch and so stop the drawing out of rod 48.

Once the stretching of rope has been completed, the water is drained from the tube assembly, and this is again opened by removing end plate 52. The treated rope can then be removed by backing this out through the tube.

Figure 5:
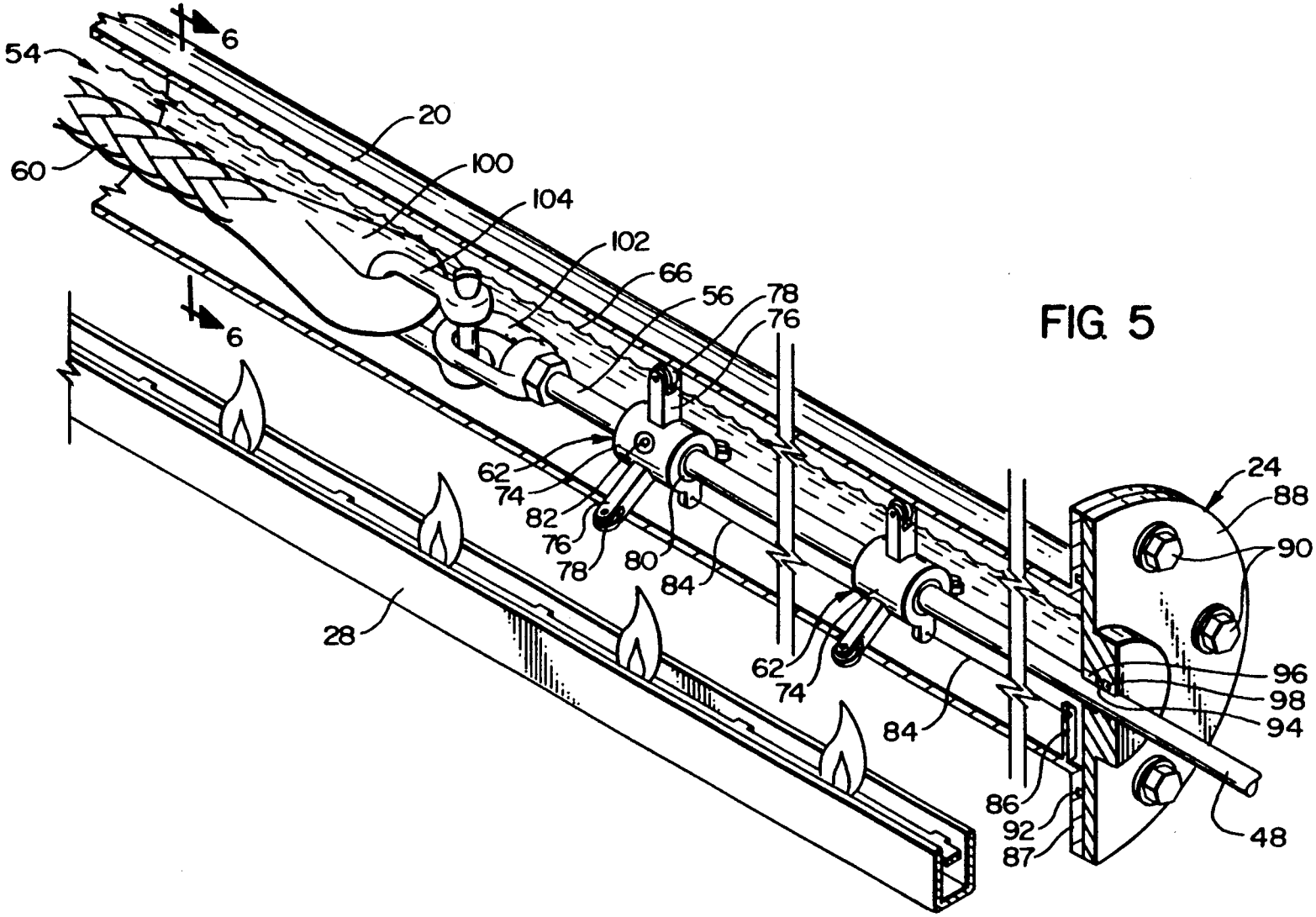
FIG. 5 is an isometric view of an end portion of the apparatus of FIGS. 1–4, this being shown partially cut away to reveal the tensioning rod which is attached to the end of the rope, and the trolley units which support this for movement within the tube.
Figure 7:
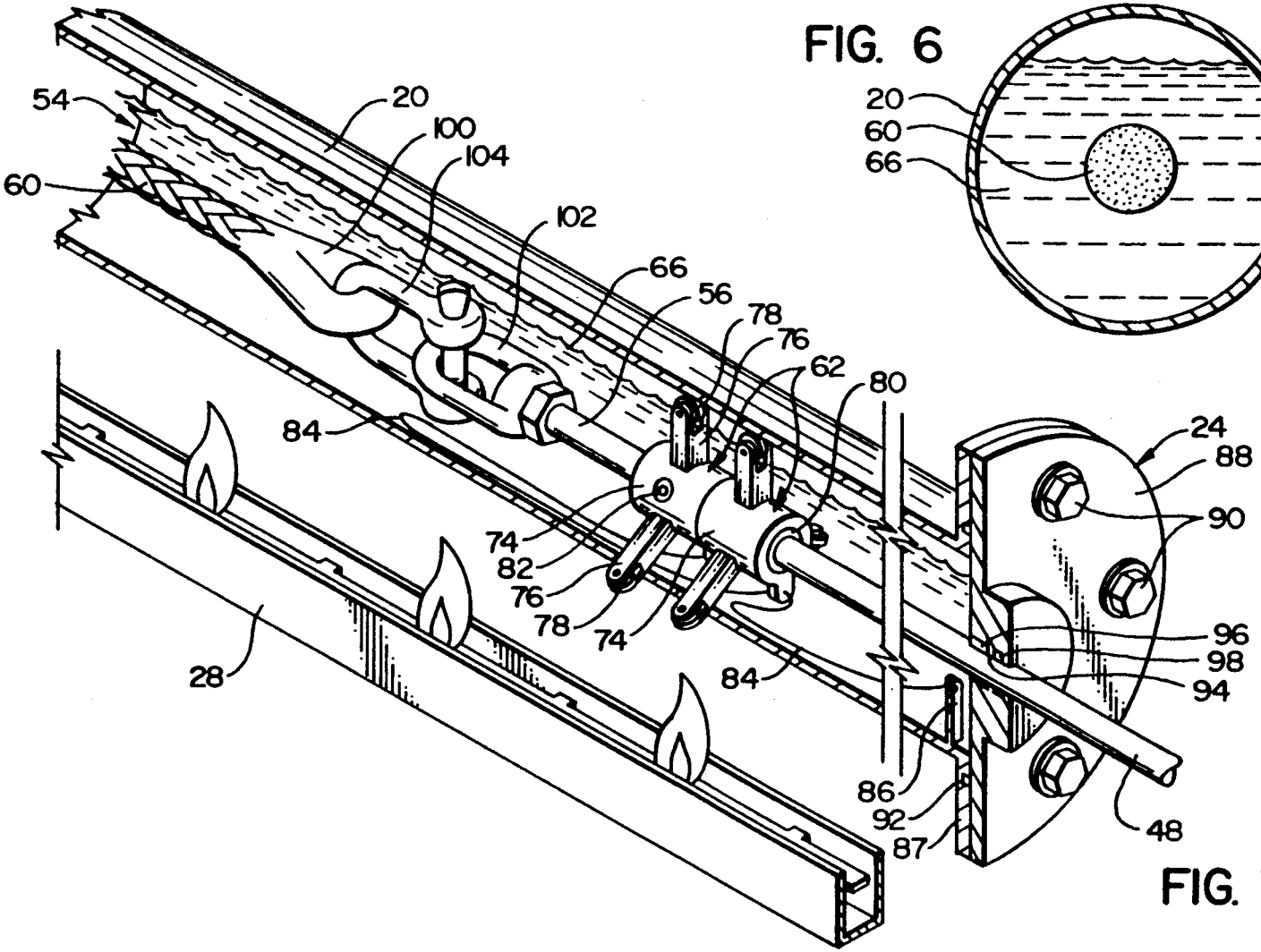
FIG. 7 is a transverse cross section taken through the tube assembly of FIG. 5 along line 7–7, this showing the manner in which the rope is buoyed within the tube by the liquid heating medium.

FIGS. 5 and 7 illustrate the structure of the trolley units which support draw rod 48 in greater detail, and also the arrangement of the seals of the end cap members. FIG. 5 shows the arrangement of the trolley units 62 when the draw rod is extended relatively far into tube member 20. As can be seen, each of the trolley units comprises a central hub 74 which fits around the draw rod, and three legs 76 which extend radially from this to support rollers 78 which bear against the inside wall of the tube member. The draw rod is supported for sliding movement through hubs 74 by bearing sleeves 80; however, the trolley unit located nearest the inner end of rod 48 is fixedly mounted to this, as by a set screw 82. A flexible line 84 is attached to this end trolley unit and extends back towards end cap member 24; the remaining trolley members 62 are attached to this line at intervals, and the end of the line is fixed to an anchor 86 near the end of the tube. Thus, as is shown in FIG. 5, when the rod 48 is pushed into the tube, the fixed end trolley unit pulls the flexible line 84 more-or-less taught, so as to position the remaining units at spaced apart distances along the length of the draw rod so that they provide proper support for this.

Then, as the rod 48 is withdrawn from the tube assembly, the trolley units "accordion" together in the manner shown in FIG. 7, so as to permit the end of the rod to be drawn to a position adjacent the end of tube member 20. As is shown, the trolley unit which is fixed near the end of the rod is drawn through the tube, and as this is done, the flexible line 84 goes slack, and the end unit moves into abutment with the next unit in line; with continued movement of the rod, this continues until all of the trolley units are pushed together into a compact group near the end of the tube.

FIGS. 5 and 7 also show the arrangement of seals at end cap member 24. As was noted above with respect to end cap 22, this is made up generally of a flange 86 which is mounted to tube member 20, and an end plate 88 which is mounted to this by bolts 90. The sealing interface between the flange and end plate is augmented by an O-ring seal 92 which extends annularly around the end of the tube. As noted above, draw rod 48 slides through a bore 94 in plate 88, and a sliding seal is provided therewith by a bearing 96 and sleeve 98. Inasmuch as the pressures and temperatures within tube member 20 are relatively moderate when stretching ropes made of Spectra TM fibers, this bearing and sleeve may be formed of nylon and Viton TM, and the sleeves 80 and rollers 78 described above can be formed of Delrin TM and nylon. Of course, if the fiber material calls for more severe temperatures and pressures for stretching, other seal materials having suitable parameters can be selected. The construction of the other end cap member 22 is substantially identical to that shown here; the sliding seal which is provided by this arrangement is necessary because link 36, although relatively stationary, must nevertheless be free to slide through the end plate so as to permit tensiometer readings to be taken, the actual amount of longitudinal movement of the link being about 1 inch.

Also seen in FIGS. 5 and 7 is the manner in which the draw rod 48 is attached to the end of rope 60. FIG. 7 shows that there is a soft eye 100 formed at the end of the rope, and this is connected to a metal ring 102 on the end of rod 48 by a shackle 104; a substantially identical arrangement is used to attach the other end of the rope to the stationary link 36. Alternatively, the ends of the rod and link can be provided with a simple hook, over which the eye at the end of the rope can be slipped.

Figure 8:
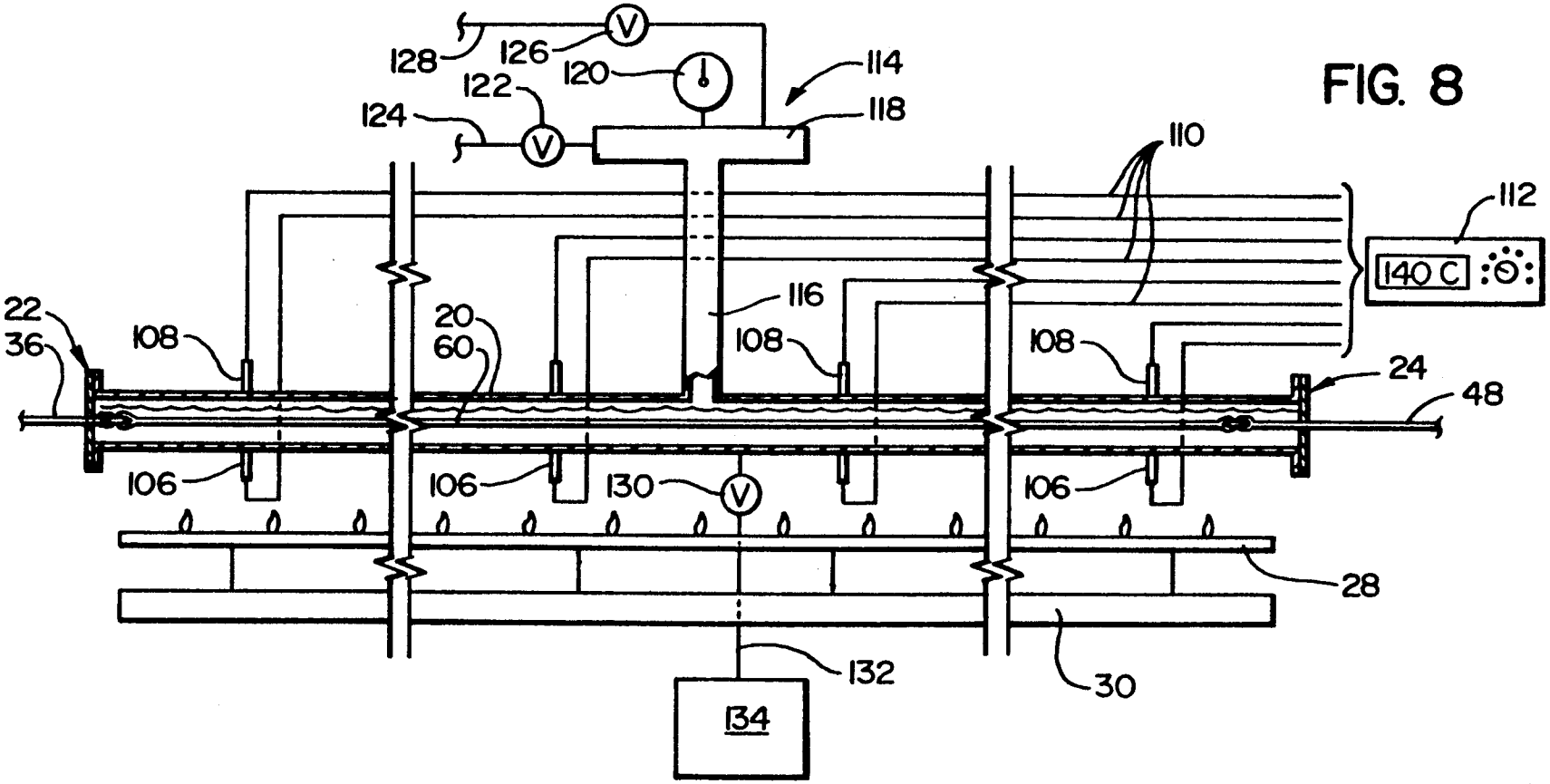
FIG. 8 is a schematic view of the apparatus of FIGS. 1–7, this also showing the control systems which are associated therewith.

FIG. 8 is a schematic view of the apparatus described above, showing its monitoring and control systems. The tube member 20 is provided with a series of temperature sensors spaced along its length; as is shown, these may include lower sensor units 106 which are mounted along the bottom of the tube member so as to measure the temperature of the water, and upper sensor units 108 which are mounted along the top of the tube so as to measure the temperature of the steam above the surface of the liquid. The sensors are connected by means of leads 110 to a monitor unit 112 which selectively displays the temperature sensed at each of the locations, so that the operator can verify that the tube has been evenly heated and there are no hot or cold spots. As was described above, this temperature equalization is achieved by a controlled bleeding of the air/steam pressure in the tube once the desired temperature has been reached. A pressure control assembly 114 is provided for this purpose, and this comprises a vertical stand pipe which extends upwardly from the tube member 20 so as to be in fluid communication with the air gap over the liquid, and a horizontal header tube 118 which is mounted to the upper end of this. A pressure gauge 120 indicates the pressure in header tube 118, and being that this is in communication with the air gap through the length of the main tube member 20, this indicates the pressure over the whole of the system. The operator observes the gauge to determine when the desired pressure has been reached, and then opens a back pressure valve 122 to relieve pressure from header tube 118 through relief line 124; by doing this, the operator is able to control the temperature of the liquid medium at the desired level for a particular fiber material, as described above.

Once the heat stretching of the rope is terminated, the operator throws open a ball valve 126 which also communicates with header tube 118; this dumps the remaining pressure in the tube assembly through discharge line 128, rapidly cooling the liquid medium and preparing the system for draining. This is performed by opening drain valve 130 so that the water drains out of the tube assembly through drain line 132, and into hot water tank 134. To enhance system efficiency, tank 134 may be insulated so that this stores the water or other liquid medium at an elevated temperature for subsequent reuse.

II. Process Considerations

As was noted above, the process of the present invention has proven especially effective for the heat stretching of ropes made up of Spectra TM fibers. The melting point of this material is 147° C., and it has been found that heat stretching of such ropes can be performed within the range from about 125° C. to 150° C.; in general, it has been found that the range from about 140°-150° C. is optimal, being that at lower temperatures (e.g., 135° C.), the measured increase in tensile strength was found to drop off, and below about 130° C., filament breakage began to be observed.

In addition to temperature, other control factors which were found to have an impact on the quality of the finished rope included the total percent increase in length, and also the pull speed at which the rope is stretched. The following example illustrates experimental results which were achieved by controlling these factors.

EXAMPLE

| Material-Spectra TM Braided Rope | |
|---|---|
| Stretch Temperature | 140° C. |
| Total Length Increase | 67% |
| Pull Speed | 36%/min. |
| Initial Tensile Strength | 13.59 gm/denier (gpd) |
| Finished Tensile Strength (after heat stretching) | 23.58 gpd |
| Increase in Tensile Strength | 78% |
| Initial Length of Elongation at Break | 6.9% |
| Finished Length of Elongation at Break | 3.2% |

These results clearly demonstrate the increased tensile strength and decreased length of elongation at break (i.e., "stretch") of the finished product.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A method for heat stretching a synthetic fiber rope, said method comprising the steps of:

attaching tensioning members to first and second ends of a segment of said rope;

suspending said segment in a liquid medium having a specific gravity selected to be approximately equal to that of said rope at a predetermined stretching temperature, so that said segment is rendered substantially neutrally buoyant by said medium so as to minimize loading on said attached ends of said segment caused by weight or flotation of said segment;

heating said liquid medium so that said segment of rope which is suspended therein is uniformly heated to said stretching temperature; and applying tension between said tensioning members so as to stretch said heated segment of rope to a predetermined increase in length of said segment.

2. The method of claim 1, wherein the step of suspending said segment in said liquid medium comprises the steps of:

positioning said segment of rope in a closed vessel; and at least partially filling said vessel with said liquid medium.

3. The method of claim 2, wherein the step of heating said liquid medium comprises the sequential steps of:

heating said liquid medium in said vessel while maintaining a pressure in said vessel so as to prevent boiling of said liquid medium, until said liquid medium is heated to a temperature at least equal to said stretching temperature; and reducing said pressure in said vessel to a pressure at which said liquid medium will boil at said stretching temperature, so that said liquid medium is stabilized at said stretching temperature uniformly throughout said vessel.

4. The method of claim 3, wherein the step of heating said liquid medium further comprises the subsequent step of maintaining boiling of said liquid medium at said stretching temperature for a predetermined period of time which is sufficient to overcome a thermal insulating quality of said rope so that said segment of rope is uniformly heated to said stretching temperature to a core of said rope.

5. The method of claim 3, further comprising the step of reducing said pressure and temperature in said vessel so as to cool said stretched segment of rope below said stretching temperature.

6. The method of claim 5, wherein said step of reducing said temperature and pressure in said vessel comprises rapidly reducing said pressure in said vessel to atmospheric pressure so that said temperature of said liquid medium is rapidly reduced below said stretching temperature.

7. The method of claim 5, further comprising the step of maintaining a predetermined amount of tension on said segment of rope as said pressure and temperature in said vessel is reduced so as to prevent shrinkage of said segment of rope as said segment cools.

8. The method of claim 1, further comprising the step of selecting said stretching temperature such that tensile resistance of said synthetic fiber rope is reduced to a level at which said segment of rope may be stretched at a predetermined rate of elongation substantially without breakage of fibers of said rope.

9. The method of claim 8, wherein said step of selecting said stretching temperature comprises selecting said stretching temperature so that said stretching temperature is approximately equal to a melting temperature of fibers of said synthetic fiber rope.

10. A method for heat stretching a synthetic fiber rope, said method comprising the steps of:

attaching tensioning members to first and second ends of a segment of said rope;

positioning said segment of roe in a vessel so that said segment extends generally horizontally therein, and at least partially filling said vessel with a liquid medium, said liquid medium having a specific gravity approximately equal to that of said rope at a predetermined stretching temperature so that said segment is buoyed by said medium so as to relieve the weight of said segment from said tensioning members at said ends thereof;

heating said liquid medium in said vessel while maintaining a pressure in said vessel so as to prevent boiling of said liquid medium, until said liquid medium is heated to a temperature at least equal to said stretching temperature;

reducing said pressure in said vessel to a pressure at which said liquid medium will boil at said stretching temperature, so that said liquid medium is stabilized at said stretching temperature uniformly throughout said vessel and said segment of rope which is buoyed therein is uniformly heated to said stretching temperature; and applying tension between said tensioning members so as to stretch said heated segment of rope to a predetermined increase in length of said segment.

11. The method of claim 10, further comprising the step of maintaining boiling of said liquid medium at said stretching temperature for a predetermined period of time which is sufficient to overcome a thermal insulating quality of said rope so that said segment of rope is uniformly heated to said stretching temperature to a core of said rope.

12. The method of claim 10, further comprising the step of reducing said pressure and temperature in said vessel so as to cool said stretched segment of rope below said stretching temperature.

13. The method of claim 12, wherein said step of reducing said temperature and pressure in said vessel comprises rapidly reducing said pressure in said vessel to atmospheric pressure so that said temperature of said liquid medium is rapidly reduced below said stretching temperature.

14. The method of claim 12, further comprising the step of maintaining a predetermined amount of tension on said segment of rope as said pressure and temperature in said vessel is reduced so as to prevent shrinkage of said segment of rope as said segment cools.

* * * * *